US009101984B2

(12) United States Patent
Bono et al.

(10) Patent No.: US 9,101,984 B2
(45) Date of Patent: Aug. 11, 2015

(54) HIGH HARDNESS, CORROSION RESISTANT PM NITINOL IMPLEMENTS AND COMPONENTS

(71) Applicant: Summit Materials, LLC, McDonald, PA (US)

(72) Inventors: Eric S. Bono, McDonald, PA (US); Charles Frederick Yolton, Moon Township, PA (US)

(73) Assignee: SUMMIT MATERIALS, LLC, McDonald, PA (US)

( * ) Notice: Subject to any disclaimer, the term of this patent is extended or adjusted under 35 U.S.C. 154(b) by 266 days.

(21) Appl. No.: 13/677,600

(22) Filed: Nov. 15, 2012

(65) Prior Publication Data

US 2013/0118312 A1 May 16, 2013

Related U.S. Application Data

(60) Provisional application No. 61/560,403, filed on Nov. 16, 2011.

(51) Int. Cl.

| | |
|---|---|
| ***B22F 3/24*** | (2006.01) |
| ***B26B 9/00*** | (2006.01) |
| ***B22F 3/15*** | (2006.01) |
| ***B22F 3/18*** | (2006.01) |
| ***B22F 5/00*** | (2006.01) |
| *C22C 1/04* | (2006.01) |

(52) U.S. Cl.

CPC ... *B22F 3/24* (2013.01); *B22F 3/15* (2013.01); *B22F 3/18* (2013.01); *B22F 5/006* (2013.01); *B26B 9/00* (2013.01); *B22F 2998/10* (2013.01); *C22C 1/0433* (2013.01)

(58) Field of Classification Search

USPC ..... 419/28, 49

See application file for complete search history.

(56) References Cited

U.S. PATENT DOCUMENTS

| | | | | |
|---|---|---|---|---|
| 3,455,682 | A | 7/1969 | Barbaras | |
| 3,469,976 | A | 9/1969 | Iler | |
| 3,888,663 | A | 6/1975 | Reichman | |
| 4,041,123 | A | 8/1977 | Lange et al. | |
| 4,081,272 | A | 3/1978 | Adlerborn | |
| 4,104,782 | A | 8/1978 | Veeck et al. | |
| 4,212,669 | A | 7/1980 | Veeck et al. | |
| 4,339,271 | A | 7/1982 | Isaksson et al. | |
| 4,399,611 | A | 8/1983 | Maringer | |
| 4,435,360 | A | 3/1984 | Trottier et al. | |
| 4,478,789 | A | 10/1984 | Nilsson et al. | |
| 4,881,430 | A | 11/1989 | Hubbard | |
| 4,915,605 | A | 4/1990 | Chan et al. | |
| 4,932,210 | A | 6/1990 | Julien et al. | |
| 5,005,678 | A | 4/1991 | Julien et al. | |
| 5,013,507 | A | 5/1991 | Julien et al. | |
| 5,046,426 | A | 9/1991 | Julien et al. | |
| 5,089,197 | A | 2/1992 | Butler et al. | |
| 5,174,952 | A | 12/1992 | Jongenburger et al. | |
| 5,226,683 | A | 7/1993 | Julien et al. | |
| 5,856,631 | A | 1/1999 | Julien | |
| 5,868,013 | A | 2/1999 | Julien | |
| 6,043,451 | A | 3/2000 | Julien et al. | |
| 6,065,934 | A | 5/2000 | Jacot et al. | |
| 6,073,469 | A | 6/2000 | Julien | |
| 6,254,458 | B1 | 7/2001 | Julien | |
| 6,267,402 | B1 | 7/2001 | Julien | |
| 6,293,020 | B1 | 9/2001 | Julien | |
| 6,410,886 | B1 | 6/2002 | Julien | |
| 6,422,010 | B1 | 7/2002 | Julien | |
| 6,425,829 | B1 | 7/2002 | Julien | |
| 6,454,016 | B1 | 9/2002 | Julien | |
| 6,530,564 | B1 | 3/2003 | Julien | |
| 6,571,665 | B2 | 6/2003 | Julien | |
| 6,581,522 | B1 | 6/2003 | Julien et al. | |
| 6,615,702 | B1 | 9/2003 | Julien | |
| 6,715,701 | B1 | 4/2004 | Julien | |
| 6,857,558 | B2 | 2/2005 | Ferry, III et al. | |
| 6,886,986 | B1 | 5/2005 | Julien | |
| 7,005,018 | B2 | 2/2006 | Julien | |
| 7,135,141 | B2 * | 11/2006 | Han et al. | 419/54 |
| 7,172,519 | B2 | 2/2007 | Byrne et al. | |
| 8,047,552 | B2 | 11/2011 | Julien | |
| 8,182,741 | B1 | 5/2012 | DellaCorte et al. | |
| 8,377,373 | B1 * | 2/2013 | Glennon et al. | 419/29 |
| 8,475,711 | B2 * | 7/2013 | Wojcik | 419/23 |
| 2002/0083598 | A1 | 7/2002 | Julien | |
| 2002/0187020 | A1 | 12/2002 | Julien | |
| 2003/0162050 | A1 | 8/2003 | Ferry, III et al. | |
| 2004/0168752 | A1 | 9/2004 | Julien | |
| 2005/0082773 | A1 | 4/2005 | Julien | |

OTHER PUBLICATIONS

Schuller et al, Hot Isostatic Pressing (HIP) of Elemental Powder Mixtures and Prealloyed Powder for NiTi Shape Memory Parts, Advanced Engineering Materials, 2003, 5, No. 12.*

* cited by examiner

*Primary Examiner* — George Wyszomierski
*Assistant Examiner* — Ngoclan T Mai
(74) *Attorney, Agent, or Firm* — Nixon & Vanderhye, PC

(57) ABSTRACT

A manufacturing method for making components includes: providing at least one of a prealloyed powder of a composition of Ni—Ti in the range of Ni-36Ti to Ni-45Ti or a mix of powders that forms a composition of Ni—Ti in the range of Ni-36Ti to Ni-45Ti; loading at least one of the prealloyed powder and the mix powders into a container; hot isostatically pressing (HIP) the container to full density to obtain a compact; rolling the compact in a mill with multiple passes to produce a sheet or other mill form material; and cutting blanks for the components from the sheet material to produce a component blank.

15 Claims, No Drawings

HIGH HARDNESS, CORROSION RESISTANT PM NITINOL IMPLEMENTS AND COMPONENTS

CROSS-REFERENCE TO RELATED APPLICATION

This application claims the benefit of U.S. Provisional Application No. 61/560,403 filed Nov. 16, 2011, which is incorporated by reference herein in its entirety.

BACKGROUND OF THE INVENTION

1. Field of the Invention

The present invention relates, in general, to the powder metallurgy production of metallic implements and components by hot isostatic pressing (HIP) of powder and, more particularly, to the powder metallurgy production of metallic implements and components by HIP plus wrought processing after consolidation. The present invention further relates to powder metallurgy production of metallic implements from a Nitinol alloy for service requiring properties such as high hardness and corrosion resistance.

2. Description of Related Art

Nitinol is an intermetallic compound of nickel and titanium which was serendipitously discovered at the Naval Ordinance Laboratory by W. J. Buehler in 1959. One of the Nitinol compositions (Ni-40Ti weight percent) has unique properties that cannot be found in other materials. This composition can be heat treated to a hardness of Rockwell C 60 or higher and is wear resistant and non-galling even though it has a high titanium content. In addition, although it has a high nickel content, it is non-magnetic. It is also highly corrosion resistant in a variety of media. The density is 86 percent of the density of steel which is advantageous in applications where weight is a consideration. This composition also has superelastic and shape memory properties.

Even though this composition has a number of attractive properties, it has not seen significant usage because it is a difficult composition to process by the common metallurgical practice of ingot melting followed by hot and cold working. This composition in cast form can be brittle and can crack unexpectedly under otherwise normal processing conditions. Several attempts have been made to manufacture implements with this composition using an ingot metallurgy or investment casting approach. However, due to the difficulties in conventional ingot metallurgy processing of this composition it has not been widely used.

Accordingly, a need exists for an improved process for producing implements and components from the Ni-40Ti composition that overcomes the deficiencies of using an ingot metallurgy or investment casting approach.

SUMMARY OF THE INVENTION

Therefore, it is an object of this invention to provide an improved process for producing implements and components from the Ni-40Ti composition. The process of the present invention is a powder metallurgy method in which Ni-40Ti powder is consolidated by hot isostatic pressing at an appropriate temperature, pressure, and time to make a fully dense article which is suitable for further wrought processing to produce plate, sheet, and other mill product forms. While Ni-40Ti compositions are discussed hereinafter, this is not to be construed as limiting the present invention as the composition may include Ni-36Ti to Ni-45Ti and may further include up to 5 weight percent alloying elements.

More specifically, provided is a manufacturing method for making implements and components that includes: providing at least one of a prealloyed powder of a composition of Ni—Ti in the range of Ni-36Ti to Ni-45Ti or a mix of powders that forms a composition of Ni—Ti in the range of Ni-36Ti to Ni-45Ti; loading at least one of the prealloyed powder or the mix of powders into a container; hot isostatically pressing (HIP) the container to full density to obtain a compact; rolling the compact in a mill with multiple passes to produce a sheet material or other mill forms; and cutting blanks for the components from the sheet material to produce a component blank. The mix of powders may be a mix of nickel and titanium constitutive elemental powders that forms a composition of Ni—Ti in the range of Ni-36Ti to Ni-45Ti.

The container may be manufactured from low carbon steel and may have a rectangular or round shape. The pressures produced during the hot isostatically pressing (HIP) may be between about 10,000 psi and about 30,000 psi and the temperature may range from about 1600° F. to about 2000° F. The compact may be encased in an insulating medium after the hot isostatically pressing (HIP). A temperature of the compact may be kept above about 1200° F. during the rolling.

The manufacturing method may further include a flattening of the sheet material to produce flattened sheet material. The flattening may be performed by reheating the sheet material and processing the sheet material in flattening equipment. In addition, the manufacturing method may further include the step of annealing the flattened sheet material.

The cutting may be performed by water jet, laser cutting, electronic discharge machining (EDM), or any combination thereof. After the step of cutting, the method may further include the step of grinding a profile into the component blank. The grinding may be performed using fast speed and relatively shallow pass depths while flushing the component blank with coolant.

These and other features and characteristics of the present invention, as well as the methods of operation and functions of the related elements of structures, will become more apparent upon consideration of the following description. As used in the specification and the claims, the singular form of "a", "an", and "the" include plural referents unless the context clearly dictates otherwise.

DESCRIPTION OF THE PREFERRED EMBODIMENTS

It is also to be understood that the specific methods described in the following specification are simply exemplary embodiments of the invention. Hence, specific dimensions and other physical characteristics related to the embodiments disclosed herein are not to be considered as limiting.

The steps used to create cutting instruments, and other instruments and tools such as skate blades, out of powder metal Ni-40 Ti wt % is summarized below.

Start with either prealloyed powder or a mix of powders in a mesh fraction typically between −35 through −400 US Standard mesh. The powder is then loaded into a container, typically low carbon steel, which is shaped in a rectangular or round fashion to become the preform that is subsequently formed to plate, sheet, bar, or other mill product form. The sealed container is then hot isostatically pressed (HIP) to full density prior to further processing, thereby forming a compact. HIP pressures are typically between 10,000-30,000 psi and the temperature ranges from 1600° F. to 2000° F.

The HIP compact can then be further encased in an insulating medium or, more desirably, the HIP container acts as the insulating material for the pending rolling sequence. Two methods which would make it possible to roll the compact without encasing it in an insulating pack, would be to either roll on a mill which has heated rolls or use frequent reheating to keep the slab's temperature above about 1200° F. However, production mills of this type are not readily available and the cost would be greater than rolling on a standard mill in an insulating pack. In addition to helping retain heat, the insulating pack also helps to minimize the scale that may build up on the material during heating for rolling.

Once the HIP process is completed a rolling procedure is commenced. The rolling procedure includes multiple passes in the mill with frequent reheating of the compact to ensure that the temperature of the compact remains above about 1200° F. If the temperature of the compact is not kept above about 1200° F., the Ni-40Ti may become too brittle to survive the rolling process without fracturing.

In the case of hot rolled sheet or plate the final material is typically not flat after rolling and further processing operations require a reasonably flat product. Accordingly, the sheet or plate obtained after rolling may be flattened on equipment specifically designed for flattening by reheating to the rolling temperature and processing it in the flattening equipment. An alternate method of flattening is to sandwich the plate/sheet between heavy flat plates of a material like stainless steel. The sandwiched plate/sheet is then placed in a furnace at a temperature above approximately 1300° F. and the weight of the plate on top of the Ni-40Ti to be flattened produces the required flatness. The advantage of this method is that the flattening process can be combined with an annealing heat treatment after rolling. A separate annealing operation would be required with the former flattening method.

Typical thicknesses for many cutting applications range between about 0.060 and 0.250 inches. Due to the need for attaining completely parallel surfaces in the resulting product, excess material is usually left on the thickness in the range of 0.005-0.030 inches per side.

If an encasing insulating pack is used during rolling, it would be removed after flattening and annealing. If the pack is steel, there may not be a metallurgical bond between the Ni-40Ti and the steel and it is often adequate to simply trim the edges of the plate so that the pack can be removed by hand. In some instances, it may be necessary to mechanically remove the pack by grinding, machining or possibly a chemical method.

Any suitable implement or component may thereafter be obtained from the flattened sheet using appropriate processing methods. For instance, knife or tool blanks may simply be cut out of the flattened sheet. This can be accomplished by water jet, laser cutting, or electronic discharge machining (EDM). Water jet is typically the method of choice because it is more economical. Any holes that are in the knife design to allow one-handed operation or for handle fasteners can also be put in at this point to minimize the total number of operations needed.

After the knife blank is cut, it is now ready for grinding a profile into it. Ni-40Ti can be a difficult material to machine, but robust grinding procedures in accordance with the present invention have been developed for the material. A recommended procedure for both grinding and machining is to use fast speed and relatively shallow pass depths while flushing the material with coolant. It is important to ensure that the material does not overheat. It can be advantageous to perform this step with the material heat treated to a relatively low hardness level (HRC 27-35). After the knife geometry is at an acceptable level, the blank is heat treated to the final hardened state (HRC 45-65) to attain the optimum combination of edge retention and toughness. The final, or primary, edge on the knife is typically ground after the knife is heat treated to the hardened condition to prevent any edge distortion that may occur during heat treating.

At this point, the surface of the knife is ready for a final preparation treatment. This can range from a mirror-like polish to a surface roughing to ensure the material is non-reflective as would be desired for military applications. It may also be colored by heat treatment or electrolytic treatment to provide custom coloring and branding options.

In an alternative embodiment, pre-alloyed Ni-40Ti powder may be deposited onto a less expensive substrate such as steel or titanium in order to give the attractive properties on the surface of the component at a less total cost than a monolithic implement/component, with the final product having additional advantageous properties. For example, the core material may be selected to have a property such as high toughness, compared to Ni-40Ti.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is

1. A manufacturing method for making components, comprising:

providing at least one of a prealloyed powder of a composition of Ni—Ti in the range of Ni-36Ti to Ni-45Ti or a mix of powders that forms a composition of Ni—Ti in the range of Ni-36Ti to Ni-45Ti;

loading at least one of the prealloyed powder or the mix of powders into a container;

hot isostatically pressing (HIP) the container to full density to obtain a compact;

rolling the compact in a mill above 1200° F. to avoid cracking with multiple passes to produce a sheet or other mill form material;

cutting blanks for the components from the sheet material to produce a component blank, heat treating the component blank to achieve a low hardness HRC(27-35) for optimal finishing operations, conducting finishing metal forming and removal or grinding operations on the component blank in the low hardness condition; and heat treating a finished component blank to high hardness HRC(45-65) for fine finishing for edge retention and/or durability.

2. The manufacturing method of claim 1, wherein the mix of powders is a mix of nickel and titanium constitutive elemental powders that forms a composition of Ni—Ti in the range of Ni-36Ti to Ni-45Ti.

3. The manufacturing method of claim 1, wherein the container is manufactured from low carbon steel.

4. The manufacturing method of claim 1, wherein the container has one of a rectangular shape and a round shape.

5. The manufacturing method of claim 1, wherein pressures produced during the hot isostatically pressing (HIP) are between about 10,000 psi and about 30,000 psi.

6. The manufacturing method of claim 1, wherein a temperature during the hot isostatically pressing (HIP) ranges from about 1600° F. to about 2000° F.

7. The manufacturing method of claim 1, further comprising encasing the compact in an insulating medium after the hot isostatically pressing (HIP).

8. The manufacturing method of claim 1, further comprising flattening the sheet material to produce flattened sheet material.

9. The manufacturing method of claim 8, wherein the flattening is performed by reheating the sheet material and processing the sheet material in flattening equipment.

10. The manufacturing method of claim 8, further comprising annealing the flattened sheet material.

11. The manufacturing method of claim 1, wherein the cutting is performed by water jet, laser cutting, electronic discharge machining (EDM), or any combination thereof.

12. The manufacturing method of claim 1, further comprising grinding a profile into the component blank.

13. The manufacturing method of claim 12, wherein the grinding is performed using fast speed and relatively shallow pass depths while flushing the component blank with coolant.

14. The manufacturing method of claim 1, wherein the component is a knife.

15. The manufacturing method of claim 1 wherein the prealloyed powder composition contains up to 5% of other alloy elements.

* * * * *